US010344412B2

(12) United States Patent
Ebata et al.

(10) Patent No.: US 10,344,412 B2
(45) Date of Patent: Jul. 9, 2019

(54) THREADING DEVICE OF SEWING MACHINE

(71) Applicant: JANOME SEWING MACHINE CO., LTD., Hachioji-shi, Tokyo (JP)

(72) Inventors: Yoshikazu Ebata, Hachioji (JP); Masashi Ninomiya, Hachioji (JP)

(73) Assignee: JANOME SEWING MACHINE CO., LTD., Hachioiji-Shi, Tokyo (JP)

( * ) Notice: Subject to any disclaimer, the term of this patent is extended or adjusted under 35 U.S.C. 154(b) by 534 days.

(21) Appl. No.: 15/055,383

(22) Filed: Feb. 26, 2016

(65) Prior Publication Data

US 2016/0289879 A1 Oct. 6, 2016

(30) Foreign Application Priority Data

Mar. 30, 2015 (JP) ..... 2015-069481

(51) Int. Cl.

*B32B 7/08* (2019.01)
*D05B 87/02* (2006.01)
*D05B 81/00* (2006.01)

(52) U.S. Cl.

CPC ..... *D05B 87/02* (2013.01); *D05B 81/00* (2013.01); *D05D 2207/04* (2013.01)

(58) Field of Classification Search

CPC ..... D05B 87/02; D05B 81/00; D05D 227/04
USPC ..... 112/225, 224
See application file for complete search history.

(56) References Cited

U.S. PATENT DOCUMENTS

| | | | | | |
|---|---|---|---|---|---|
| 304,599 | A * | 9/1884 | Bellah | D05B 87/02 | 112/225 |
| 500,235 | A * | 6/1893 | Jenkins | D05B 87/02 | 112/225 |
| 638,701 | A * | 12/1899 | Childers | D05B 87/02 | 112/225 |
| 726,083 | A * | 4/1903 | Maynard | D05B 87/02 | 112/225 |
| 1,230,378 | A * | 6/1917 | Burns | D05B 87/02 | 112/225 |
| 2,413,014 | A * | 12/1946 | Wall | D05B 87/00 | 112/225 |
| 3,540,392 | A * | 11/1970 | Kaplan | D05B 87/00 | 112/225 |
| 3,599,587 | A * | 8/1971 | Greulich | D05B 87/00 | 112/225 |

(Continued)

FOREIGN PATENT DOCUMENTS

JP H 07-284588 A 10/1995

*Primary Examiner* — Katharine Gracz
(74) *Attorney, Agent, or Firm* — McGinn IP Law Group, PLLC

(57) ABSTRACT

A threading device of a sewing machine includes: a needle bar which is supported on a sewing machine body so as to be slidable in an up-down direction and to a distal end of which a needle having a needle hole is attached; a threading shaft member which is movably supported on the sewing machine body in parallel to the needle bar; a guiding member provided at a lower end of the threading shaft member so as to guide a thread to the needle hole; and an air supplying member that supplies air to the guiding member. The guiding member includes: a guiding path portion of which the path width gradually narrows toward the needle hole such that the air supplied from the air supplying member is guided toward the needle hole.

20 Claims, 8 Drawing Sheets

(56) References Cited

U.S. PATENT DOCUMENTS

| | | | | | |
|---|---|---|---|---|---|
| 4,010,702 | A * | 3/1977 | Miyamoto | D05B 87/00 | 112/225 |
| 4,023,512 | A * | 5/1977 | Miyamoto | D05B 87/00 | 112/225 |
| 4,075,959 | A * | 2/1978 | Zocher | D05B 87/00 | 112/225 |
| 4,198,915 | A * | 4/1980 | Peterson | D05B 87/00 | 112/225 |
| 4,557,408 | A * | 12/1985 | Biemans | D05B 87/00 | 223/99 |
| 5,345,888 | A * | 9/1994 | Frankel | D05B 87/00 | 112/225 |
| 5,921,193 | A * | 7/1999 | Chou | D05B 81/00 | 112/282 |
| 6,067,920 | A * | 5/2000 | Uemoto | D05B 87/00 | 112/225 |
| 2007/0227424 | A1* | 10/2007 | Park | D05B 87/02 | 112/225 |
| 2015/0284890 | A1* | 10/2015 | Tseng | D05B 53/00 | 112/154 |

* cited by examiner

Fig. 1A
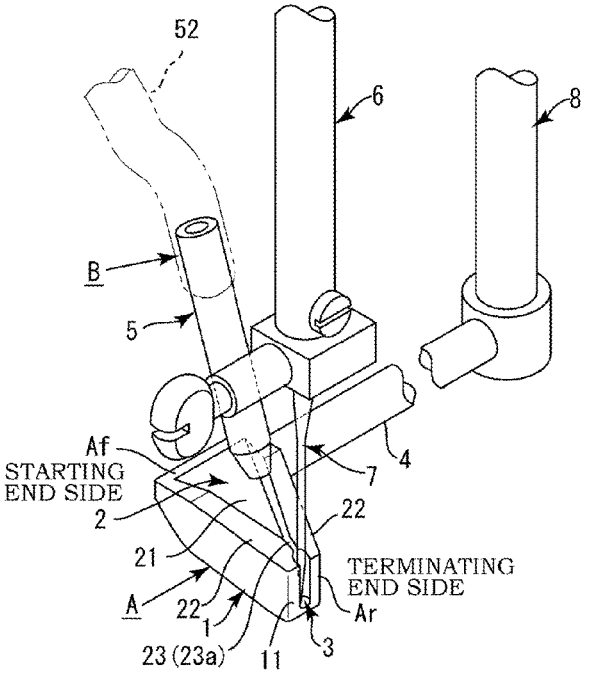
Fig. 1B
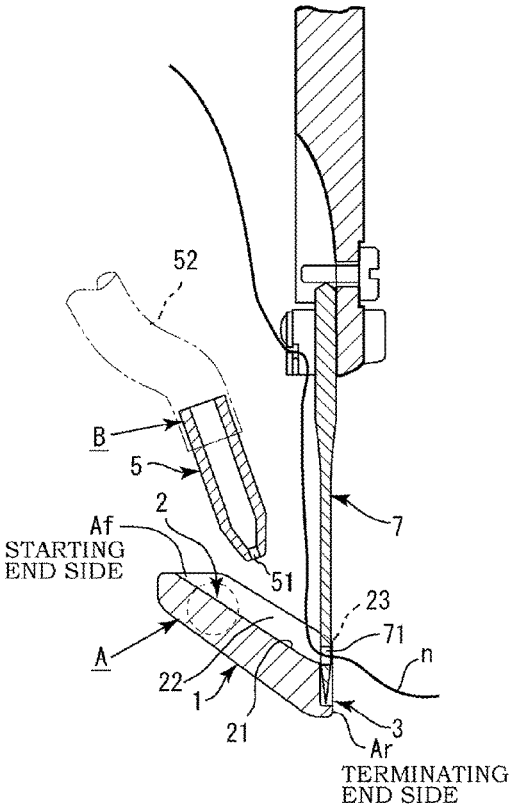
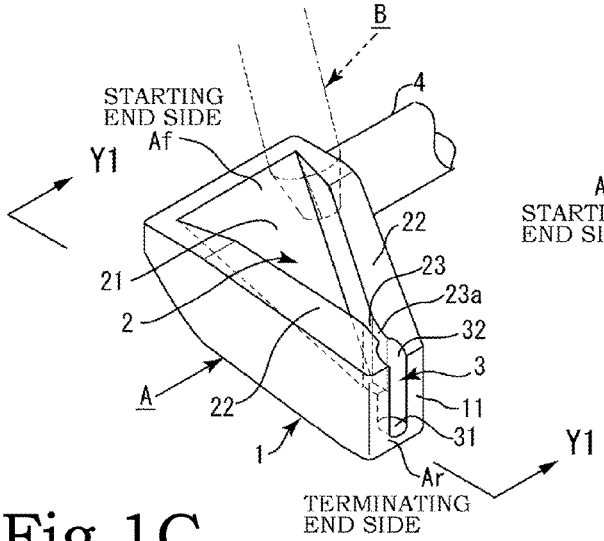
Fig. 1C
VIEW ALONG Y1-Y1
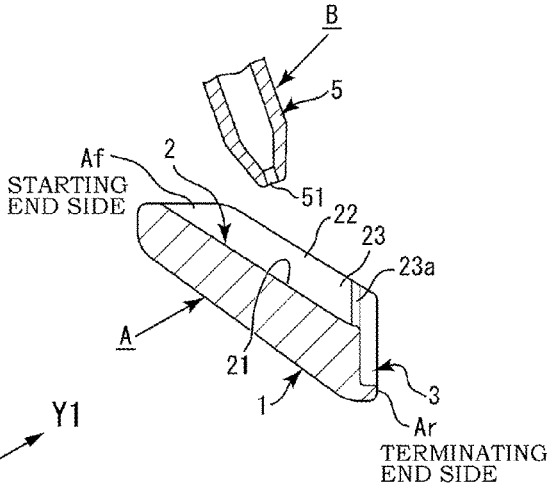
Fig. 1D Fig.2A
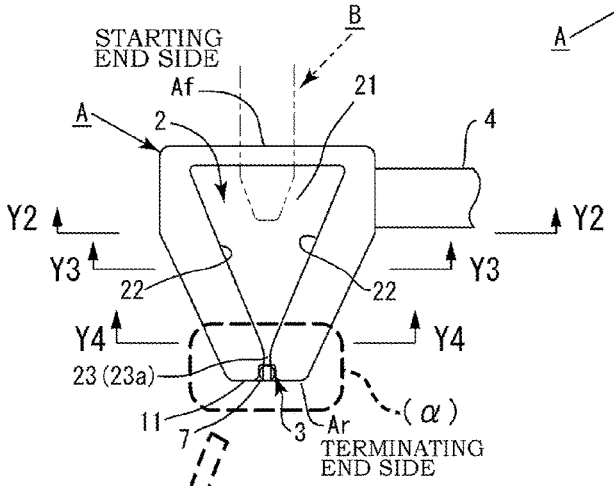
Fig.2B
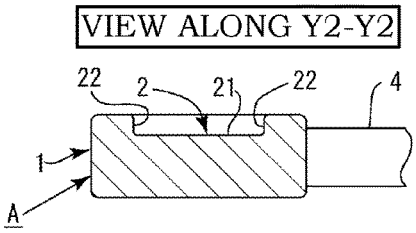
Fig.2C
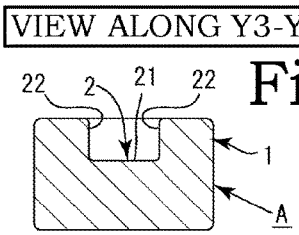
Fig.2D
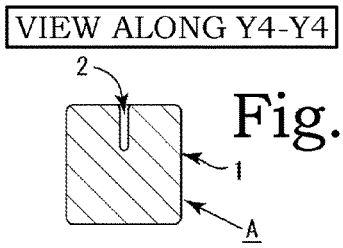
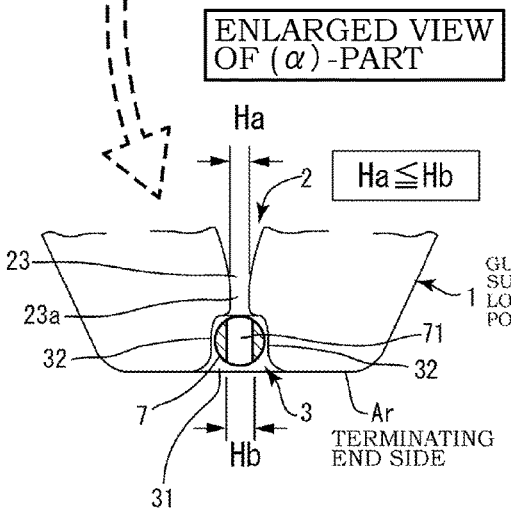
Fig.2E
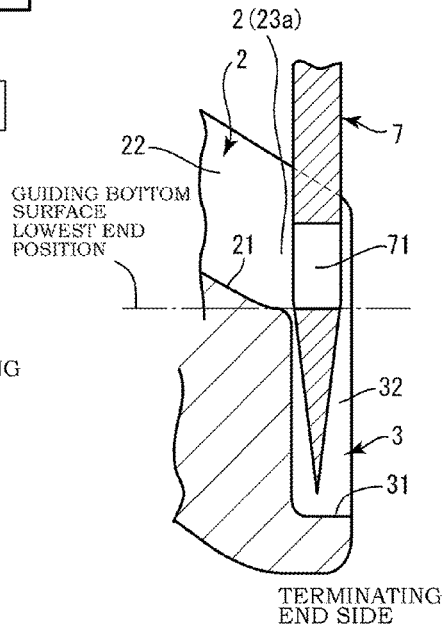
Fig.2F STARTING END SIDE
TERMINATING END SIDE
Af
Ar
B
n
4
22
23 (23a)
3
71
7
1
2
5
21

STARTING END SIDE
TERMINATING END SIDE
51
23
A

STARTING END SIDE
TERMINATING END SIDE
TERMINATING END SIDE
ENLARGED VIEW OF (γ)-PART
B
Af
Ar
A
n
1
2
3
4
5
7
21
22
23
23a
51
71
(γ)

THREADING DEVICE OF SEWING MACHINE

BACKGROUND OF THE INVENTION

1. Field of the Invention

The present invention relates to a threading device of a sewing machine, which has a very simple structure and which assists an operation of passing a thread through the needle hole of a needle.

2. Description of the Related Art

Conventionally, various threading devices have been proposed, which pass threads through the needle hole of a needle attached to a needle bar of a sewing machine. For example, the threading device disclosed in Japanese Patent Application Laid-open No. H7-284588 has a threading hook having a hook portion formed at a distal end so as to grab a thread. This threading hook grabs a thread stretched in a tense state near the needle hole of the needle by a thread holding tool and is drawn from the needle hole to perform a threading operation.

In a threading device, the threading hook drawn from a needle hole is moved upward from the needle hole such that the thread is reliably pulled out of the needle hole. With this upward movement, the thread comes off from a claw portion of the hook and the threading operation is thus completed. An example of a sewing machine having this type of mechanism is disclosed in Japanese Patent Application Laid-open No. H7-284588.

SUMMARY OF THE INVENTION

The basic mechanism of the threading device disclosed in Japanese Patent Application Laid-open No. H7-284588 is generally known and widely used. However, the mechanism disclosed in Japanese Patent Application Laid-open No. H7-284588 has the following problems. First, the hook having passed through the needle hole is drawn from the needle hole after hooking a thread and then returns to its original position, and the thread caught at the hook is folded in two.

Thus, when the hook returns to its original position, substantially two pieces of thread (that is, the thread in the folded state) together with the hook catching the thread pass through the needle hole almost at the same time. It may hence be difficult to use such a mechanism with needles having a small needle hole (that is, needles having a small yarn count).

Moreover, it is not possible to use a needle having a needle hole optimal to the thickness of a thread (that is, a needle having a yarn count optimal to the thickness of a thread), resulting in an adverse effect on the stitching quality. Here, while hooks may be formed as thinly as possible to eliminate such a problem, it is then difficult to secure a sufficient strength and such hooks may be broken.

Another problem is that if the hook does not have a sufficient strength, the hook is easily bent and may therefore not be able to enter the needle hole. Hence, in a threading device of such a type that uses a hook as disclosed in Japanese Patent Application Laid-open No. H7-284588, it is difficult to overcome the problems unique to hooks from the perspective of strength. Under such circumstances, an object of the present invention is to provide a threading device of a sewing machine in which a mechanism for inserting a sewing thread into the needle hole of a needle has a very simple structure.

As a result of intensive studies for the purpose of solving the above problems, the inventors have solved the problems by providing, as a first embodiment of the present invention, a threading device of a sewing machine, including: a needle bar which is supported on a sewing machine body so as to be slidable in an up-down direction and to a distal end of which a needle having a needle hole is attached; a threading shaft member which is movably supported on the sewing machine body in parallel to the needle bar; a guiding member provided at a lower end of the threading shaft member so as to guide a thread to the needle hole; and an air supplying member that supplies air to the guiding member, wherein the guiding member includes: a guiding path portion of which the path width gradually narrows toward the needle hole such that the air supplied from the air supplying member is guided toward the needle hole and of which the upper surface is open; and a needle receiving portion which is formed continuously to the guiding path portion so as to determine a position of the needle hole, and the needle and the thread passed through the needle hole are, after threading, removed through the open upper surface of the guiding member.

A second embodiment of the present invention solves the problems by the threading device of a sewing machine according to the first embodiment, in which a linear narrow groove portion is formed in the guiding path portion of the guiding member, and the needle receiving portion is formed continuously to the narrow groove portion. A third embodiment of the present invention solves the problems by the threading device of a sewing machine according to the first embodiment, in which an opening of the guiding path portion of the guiding member facing the needle hole of the needle disposed in the needle receiving portion has a width equal to or smaller than a width of the needle hole.

A fourth embodiment of the present invention solves the problems by the threading device of a sewing machine according to the second embodiment, in which the narrow groove portion of the guiding path portion of the guiding member facing the needle hole of the needle disposed in the needle receiving portion has a width equal to or smaller than the width of the needle hole. A fifth embodiment of the present invention solves the problems by the threading device of a sewing machine according to the first or second embodiment, in which a position of a bottom of an opening of the guiding path portion of the guiding member is identical to a position of the lower end of the needle hole of the needle disposed in the needle receiving portion.

In the present invention, the guiding member includes: the guiding path portion of which the path width gradually narrows toward the needle hole such that the air supplied from the air supplying member is guided toward the needle hole and of which the upper surface is open; and a needle receiving portion which is formed continuously to the guiding path portion so as to determine a position of the needle hole. The needle and the thread passed through the needle hole are, after threading, removed through the open upper surface of the guiding member.

Due to this, since the terminating end side of the guiding member is brought into contact with or is moved close to the needle, and the sewing thread is fed from the starting end side of the guiding path portion toward the terminating end side, the distal end of the sewing thread can easily pass through the needle hole of the needle. Moreover, since the air jetted from the air jetting nozzle of the air supplying member strikes the distal end of the sewing thread, the sewing thread can easily pass through the needle hole with the pressure of the jetted air.

BRIEF DESCRIPTION OF THE DRAWINGS

FIG. 1A is a perspective view of a first embodiment of the present invention, FIG. 1B is a longitudinal side view of the first embodiment of the present invention, FIG. 1C is a partially cut-away perspective view of a guiding member, and FIG. 1D is a cross-sectional view along arrow Y1-Y1 in FIG. 1C.

FIG. 2A is a partially cut-away plan view of the guiding member, FIG. 2B is a cross-sectional view along arrow Y2-Y2 in FIG. 2A, FIG. 2C is a cross-sectional view along arrow Y3-Y3 in FIG. 2A, FIG. 2D is a cross-sectional view along arrow Y4-Y4 in FIG. 2A, FIG. 2E is an enlarged view of (α)-part in FIG. 2A, and FIG. 2F is an enlarged longitudinal side view of (α)-part in FIG. 2A.

DESCRIPTION OF THE PREFERRED EMBODIMENTS

Figures 3A, 3B:
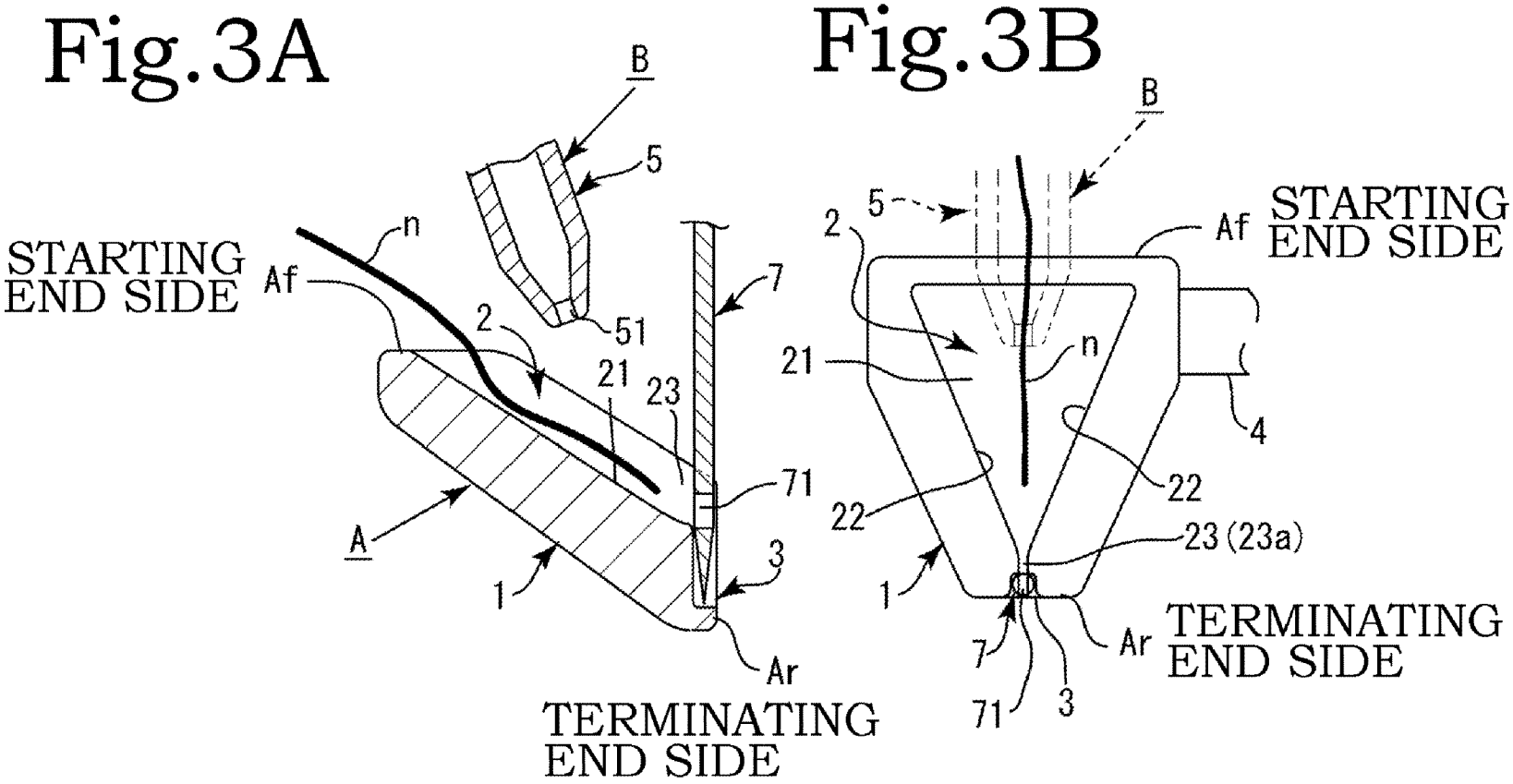
FIG. 3A is a longitudinal side view illustrating the cycle of a threading operation of providing the distal end of a sewing thread to a guiding path portion of a guiding member.
FIG. 3B is a plan view of the cycle of a threading operation of providing the distal end of a sewing thread to a guiding path portion of the guiding member.
Figure 4A:
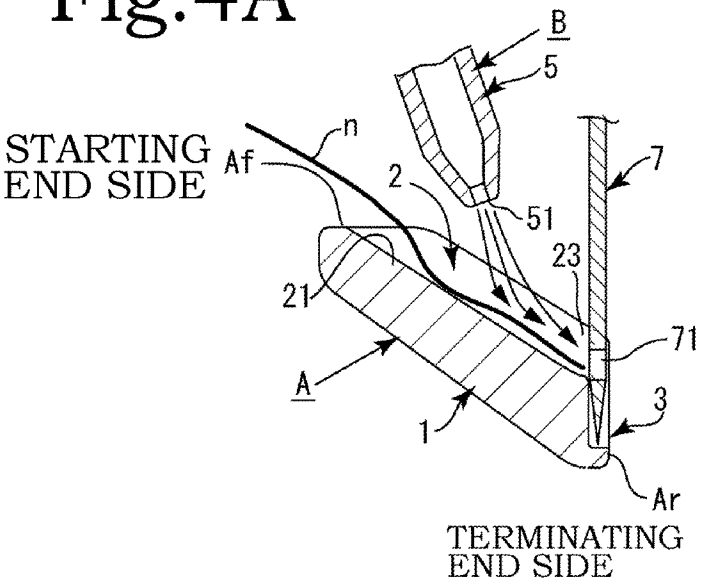
FIG. 4A is a longitudinal side view of the cycle in which air starts being jetted from an air jetting nozzle to the distal end of the sewing thread provided in the guiding path portion of the guiding member.
Figure 4B:
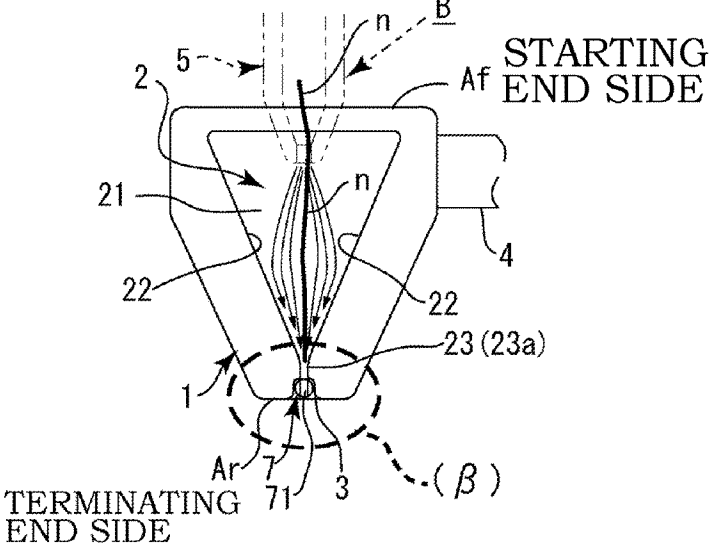
FIG. 4B is a plan view of the cycle in which air starts being jetted from the air jetting nozzle to the distal end of the sewing thread provided in the guiding path portion of the guiding member.
Figure 4C:
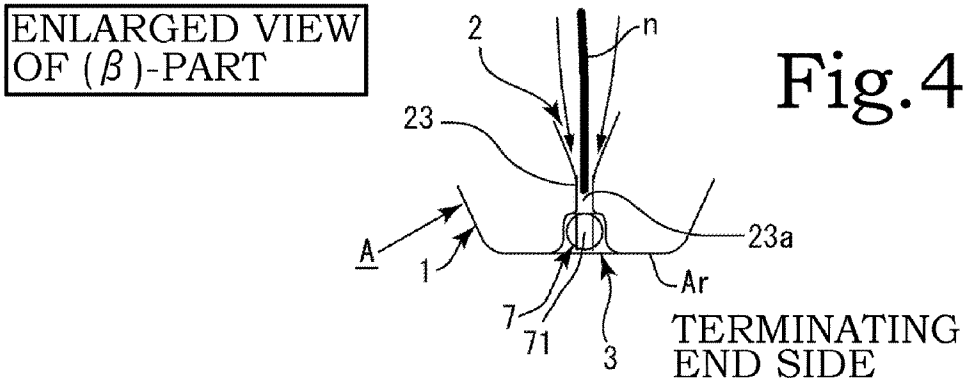
FIG. 4C is an enlarged view of (β)-part in FIG. 4B.

Hereinafter, an embodiment of the present invention will be described with reference to the drawings. As illustrated in FIGS. 1A to 1D, a threading device of the present invention mainly includes a guiding member A and an air supplying member B. These components are provided in a sewing machine body together with a needle bar 6 and a needle 7 attached to the needle bar 6. The guiding member A includes a guiding body portion 1 in which a guiding path portion 2 and a needle receiving portion 3 are provided. The guiding member A is formed of metal, synthetic resins, or the like.

The guiding body portion 1 forms an outer shape of the guiding member A, and the guiding path portion 2 is formed in the guiding body portion 1 in a substantially flat groove shape (see FIGS. 1C and 1D, FIGS. 2A to 2F, and the like). The guiding path portion 2 is a path that enables a sewing thread n to pass through a needle hole 71 of the needle 7. The guiding path portion 2 has such a shape that is recessed and open upward in a cross-section thereof (see FIG. 1C and 1D and FIGS. 2A to 2D).

The guiding path portion 2 has a starting end side Af and a terminating end side Ar, and when the sewing thread n passes through the needle hole, the distal end of the sewing thread n moves from the starting end side Af of the guiding path portion 2 toward the terminating end side Ar. That is, the starting end side Af of the guiding path portion 2 is a side in which the distal end of the sewing thread n enters and the starting end side Af is a side in which the distal end of the sewing thread n is fed through the needle hole 71 of the needle 7 (see FIGS. 3A and 3B to FIGS. 5A to 5C).

The guiding path portion 2 includes a guiding bottom surface 21 and guiding side walls 22. The guiding path portion 2 is inclined downward as it advances from the starting end side Af toward the terminating end side Ar, and a path width of the guiding path portion 2 gradually narrows from the starting end side Af toward the terminating end side Ar.

Specifically, the guiding bottom surface 21 has a planar shape and is inclined downward as it advances from the starting end side Af toward the terminating end side Ar. The guiding side walls 22 are formed on both sides in the width direction of the guiding bottom surface 21. The guiding side walls 22 are formed substantially vertically to the guiding bottom surface 21 (see FIGS. 1C and 1D, FIGS. 2A to 2D, and the like).

The guiding side walls 22 have the largest gap on the starting end side Af and have the smallest gap on the terminating end side Ar (see FIGS. 1C and 1D, FIGS. 2A to 2D, and the like). Due to this, the guiding bottom surface 21 has a substantially triangular shape or a substantially V-shape in a plan view thereof (see FIG. 2A). Moreover, a narrow groove portion 23*a* is formed at the position of an opening 23 on the terminating end side Ar of the guiding path portion 2. The narrow groove portion 23*a* is a portion that forms a part of the guiding path portion 2 and has a substantially groove shape or a substantially slit shape. Both side walls in the width direction of the narrow groove portion 23*a* are parallel and form a path (see FIGS. 1A and 1C, FIGS. 2A and 2E, and the like). The narrow groove portion 23*a* communicates with a needle receiving portion 3 described later.

The narrow groove portion 23*a* has such a width that one sewing thread n can pass therethrough. When the sewing thread n passes through the narrow groove portion 23*a*, the sewing thread n is tightened approximately linearly along the narrow groove portion 23*a*, and thus, a state in which the sewing thread n can easily pass through the needle hole 71 as it is can be created (see FIGS. 4A to 4C).

Figure 7A:
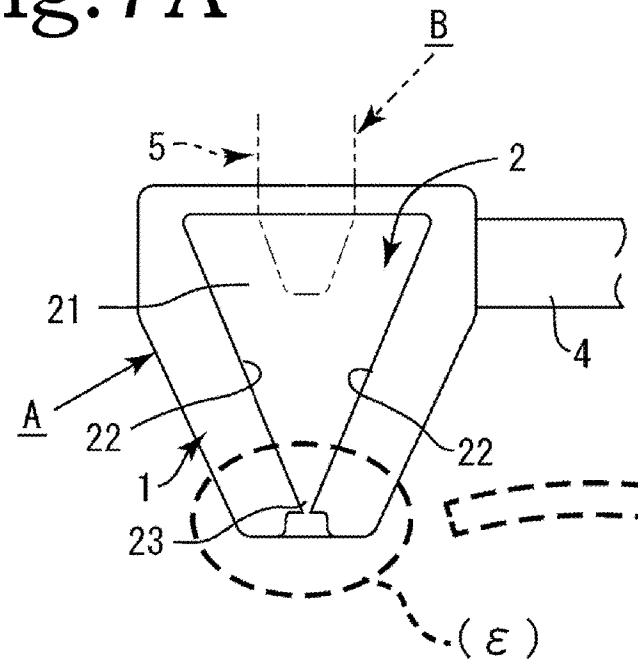
FIG. 7A is a plan view of a guiding member in which a narrow groove portion is not formed.
Figure 7B:
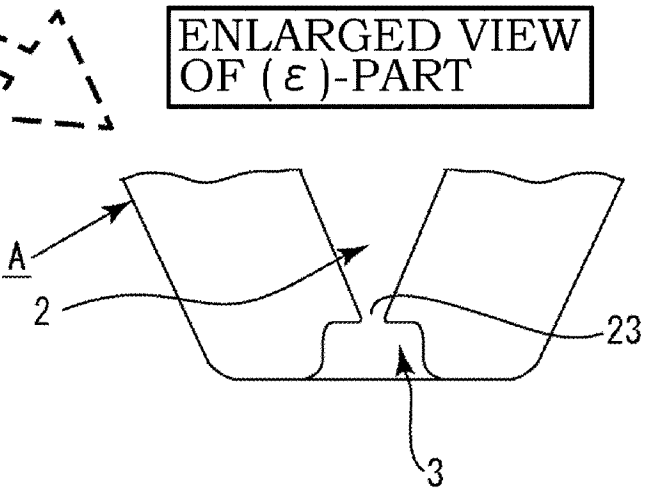
FIG. 7B is an enlarged view of (ε)-part in FIG. 7A.

An embodiment in which the narrow groove portion 23*a* is not formed in the guiding path portion 2 is also known (see FIGS. 7A and 7B). In this embodiment, an opening 23 in which the gap between both guiding side walls 22 is smallest is directly formed on the terminating end side Ar of the guiding path portion 2.

The needle receiving portion 3 is provided on the terminating end side Ar of the guiding path portion 2 and the guiding body portion 1 (see FIGS. 1C and 1D and FIGS. 2A, 2E, and 2F). The needle receiving portion 3 is a void portion in which the needle attached to the needle bar is received. The needle receiving portion 3 is a groove-shaped depression formed vertically in a vertical wall 11 on the terminating end side Ar of the guiding body portion 1. Moreover, the needle receiving portion 3 communicates with the terminating end side Ar of the guiding path portion 2 or with the narrow groove portion 23*a* when the narrow groove portion 23*a* is formed (see FIGS. 1C and 1D and FIGS. 2A, 2E, and 2F).

A portion near the lower end of the needle 7 is received in the needle receiving portion 3 (see FIGS. 1A and 1B, FIG. 3A, FIG. 4A, FIG. 5A, and the like). The needle receiving portion 3 has a receiving bottom surface 31 and is configured such that the needle cannot pass through the needle receiving portion 3 in the up-down direction. However, the needle receiving portion 3 is not limited to such a configuration, and the needle receiving portion 3 may also not have the receiving bottom surface 31 and the needle can pass through the needle receiving portion 3 in the up-down direction. Vertical circumferential walls 32 of the needle receiving portion 3 are substantially arc-shaped walls that are bilaterally symmetrical about the narrow groove portion 23*a*, and an overall shape in a direction orthogonal to the vertical direction of the needle receiving portion 3 is substantially semi-circular or substantially rectangular (see FIG. 2E).

In a state in which the needle is received in the needle receiving portion 3 of the guiding member A, a width dimension Ha of the opening 23 on the terminating end side Ar of the guiding path portion 2 is preferably equal to or smaller than a width dimension Hb of the needle hole 71 of the needle 7. That is, the two width dimensions preferably satisfy a relation of Ha≤Hb (see FIG. 2E).

The width dimension Ha on the terminating end side Ar of the guiding path portion 2 is a width dimension of the narrow groove portion 23*a* when the narrow groove portion 23*a* is formed. When the width dimension Ha of the opening 23 on the terminating end side Ar of the guiding path portion 2 is set to be equal to or smaller than the width dimension Hb of the needle hole 71, a structure in which the distal end of the sewing thread n is likely to be guided into the needle hole 71 by the pressure of the air jetted from an air jetting nozzle 5 described later without deviating outside the needle hole 71 can be realized. However, in the present invention, it is not always necessary to set the width dimension Ha of the opening 23 on the terminating end side Ar of the guiding path portion 2 to be equal to or smaller than the width dimension Hb of the needle hole 71.

Figure 8:
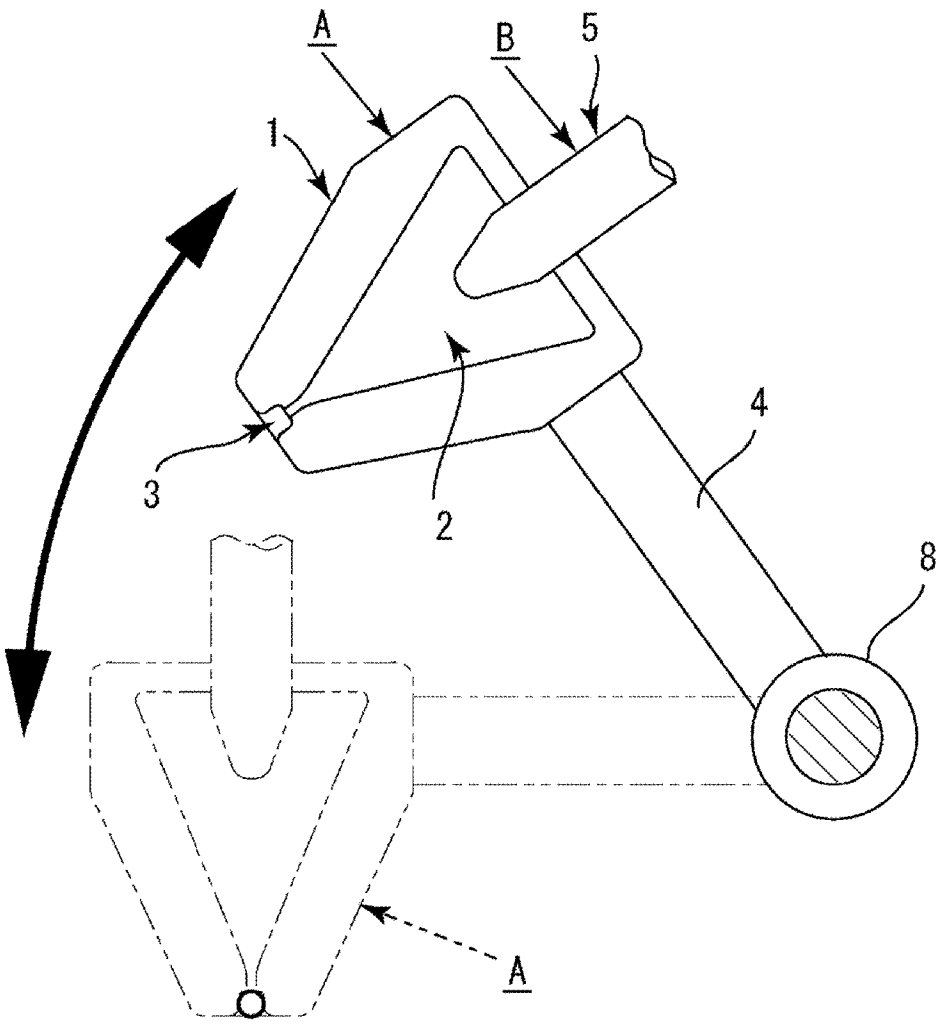
FIG. 8 is a cross-sectional plan view illustrating a state in which the guiding member and the air jetting nozzle of the present invention move toward and away from the needle.

An arm-shaped portion 4 is provided on one side surface in the width direction of the guiding body portion 1, and the arm-shaped portion 4 has a shaft shape and is connected to a threading shaft member 8 disposed in parallel to the needle bar 6 (see FIG. 1A and FIG. 8). The guiding member A and the arm-shaped portion 4 swing on a horizontal surface about the axial center of the threading shaft member 8 whereby the terminating end side Ar of the guiding member A moves toward and away from the needle hole 71 of the needle 7 (see FIG. 8).

Figures 5A, 5B, 5C:
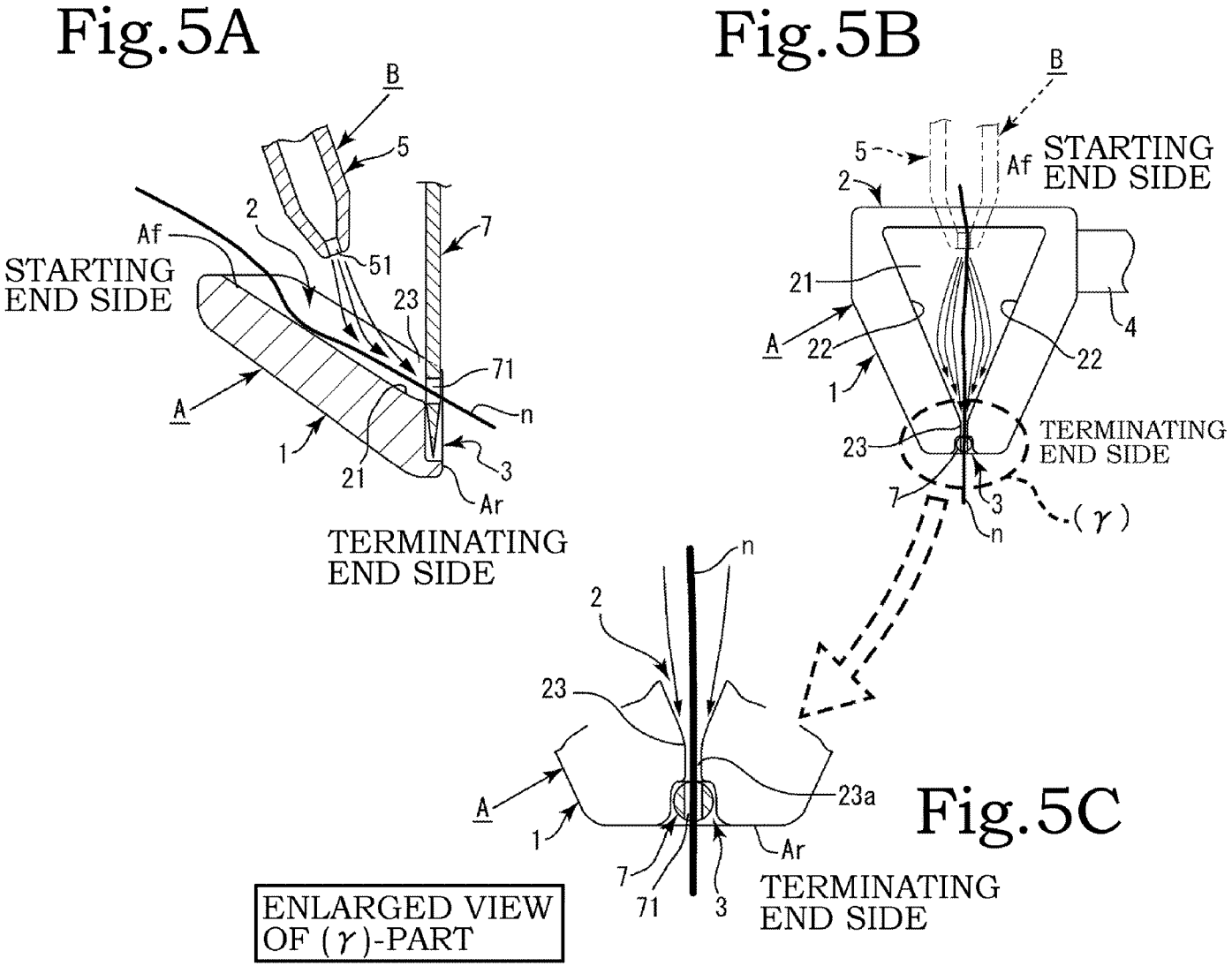
FIG. 5A is a longitudinal side view of the cycle in which the distal end of the sewing thread provided in the guiding path portion of the guiding member passes through a needle hole with the aid of the air jetting nozzle.
FIG. 5B is a plan view of the cycle in which the distal end of the sewing thread provided in the guiding path portion of the guiding member passes through a needle hole with the aid of the air jetting nozzle.
FIG. 5C is an enlarged view of (γ)-part in FIG. 5B.

The position of the guiding bottom surface 21 on the terminating end side Ar of the guiding path portion 2 is set so that the guiding bottom surface 21 falls within the range in the up-down direction of the needle hole 71 in a state in which the needle 7 is received in the needle receiving portion 3 of the guiding member A (see FIGS. 1B, 2F, 5A, and the like). More preferably, the position of the lower end of the needle hole 71 is identical (or almost identical) to or slightly lower than the position of the guiding bottom surface 21 at the position of the opening 23 on the terminating end side Ar of the guiding path portion 2. In this way, the sewing thread n can easily pass through the range in the up-down direction of the needle hole 71, and the sewing thread n can be reliably inserted into the needle hole 71 (see FIGS. 1B and 5A). Moreover, when the narrow groove portion 23*a* is formed in the guiding path portion 2, the width dimension of the narrow groove portion 23*a* is set to be equal to or smaller than the width dimension of the needle hole 71.

Specifically, the air supplying member B includes the air jetting nozzle 5, and the air jetting nozzle 5 is disposed so that a jetting port 51 is disposed at an intermediate position between the starting end side Af and the terminating end side Ar of the guiding path portion 2 (see FIGS. 1A, 1B, 1D, and the like). Moreover, the jetting direction of the air jetting nozzle 5 extends obliquely downward from the starting end side Af toward the terminating end side Ar. Moreover, the angle between the jetting direction of the air jetting nozzle 5 and the guiding bottom surface 21 of the guiding path portion 2 is preferably small and, more specifically, 45° or smaller, ideally (see FIG. 1D).

The air jetting nozzle 5 is configured such that air is supplied from an air pump or the like (not illustrated), and the air is jetted from the jetting port 51 substantially instantaneously. The air pump is operated manually or electrically. The air jetting nozzle 5 and the air pump are connected via a hose 52. Moreover, the air supplying member B (the air jetting nozzle 5) and the guiding member A are configured so that the positional relation with the guiding member A of the air jetting nozzle 5 is maintained by a supporting member or the like (not illustrated) that branches from the arm-shaped portion 4.

A cross-section of the guiding path portion 2 of the guiding member A in a direction orthogonal to the direction extending from the starting end side Af toward the terminating end side Ar may have a substantially semi-circular or arm shape. As a modified example of the embodiment, both guiding side walls 22 may be formed so as to protrude toward the outer side in an arc shape (see FIG. 5B).

According to a third embodiment of the guiding member A, a cross-section of the guiding path portion 2 in a direction orthogonal to the direction extending from the starting end side Af to the terminating end side Ar has a substantially semi-circular shape (see FIG. 5C). In this embodiment, both guiding side walls 22 and the guiding bottom surface 21 of the guiding path portion 2 have a substantially arc-shaped cross-section. The guiding bottom surface 21 and both guiding side walls 22 form a substantially semi-circular cross-section.

According to a fourth embodiment of the guiding member A, a cross-section of the guiding path portion 2 in a direction orthogonal to the direction extending from the starting end side Af toward the terminating end side Ar has a substantially V-shape or a substantially triangular shape (see FIG. 5C). In this embodiment, both guiding side walls 22 of the guiding path portion 2 are inclined so as to cross each other on the lower side. The guiding bottom surface 21 forms corners that cross each other on the lower side of both guiding side walls 22.

The guiding member A and the air jetting nozzle 5 are attached to the threading shaft member 8 provided in parallel with the needle bar 6. The threading shaft member 8 moves up and down in a vertical direction and rotates in a circumferential direction. The rotation angle is small and is preferably 90° or smaller. Although the threading shaft member 8 is normally positioned on the upper side, when a thread is passed through the needle hole 71 of the needle 7, the threading shaft member 8 is moved downward, and the guiding member A is rotated simultaneously with the movement so that the needle receiving portion 3 moves toward the needle 7 (see FIG. 8).

When the threading shaft member 8 stops its downward movement, the needle 7 is received in the needle receiving portion 3 (see FIGS. 1A and 1B). Here, the needle hole 71 of the needle 7 faces the opening 23 on the terminating end side Ar of the guiding path portion 2 (see FIGS. 1A and 1B and FIGS. 2E and 2F). Alternatively, when the narrow groove portion 23*a* is formed, the needle hole 71 of the needle 7 faces the narrow groove portion 23*a*. In this state, the distal end of the sewing thread n is disposed in the guiding path portion 2 (see FIGS. 3A and 3B).

Air is jetted from the jetting port 51 of the air jetting nozzle 5 and the pressure of the jetted air is applied to the distal end of the sewing thread n. Here, the air jetted from the jetting port 51 of the air jetting nozzle 5 strikes both guiding side walls 22 and the guiding bottom surface 21 of the guiding path portion 2 (see FIG. 4B, FIG. 5B, and the like). Thus, even when the air jetted from the jetting port 51 spreads, the air spreading while striking both guiding side walls 22 is guided while converging so that the jetted air concentrates on the opening 23 on the terminating end side Ar of the guiding path portion 2 (see FIGS. 4B and 4C and FIGS. 5B and 5C).

As a result, the distal end of the sewing thread n is supplied from the starting end side Af toward the terminating end side Ar by the pressure of the jetted air, and the sewing thread n can pass through the needle hole 71 of the needle 7 via the narrow groove portion 23*a*. In particular, the distal end of the sewing thread n is tightened approximately linearly in the narrow groove portion 23*a*, and the passing of the sewing thread n into the needle hole 71 of the needle 7 is realized more reliably.

Figure 6:
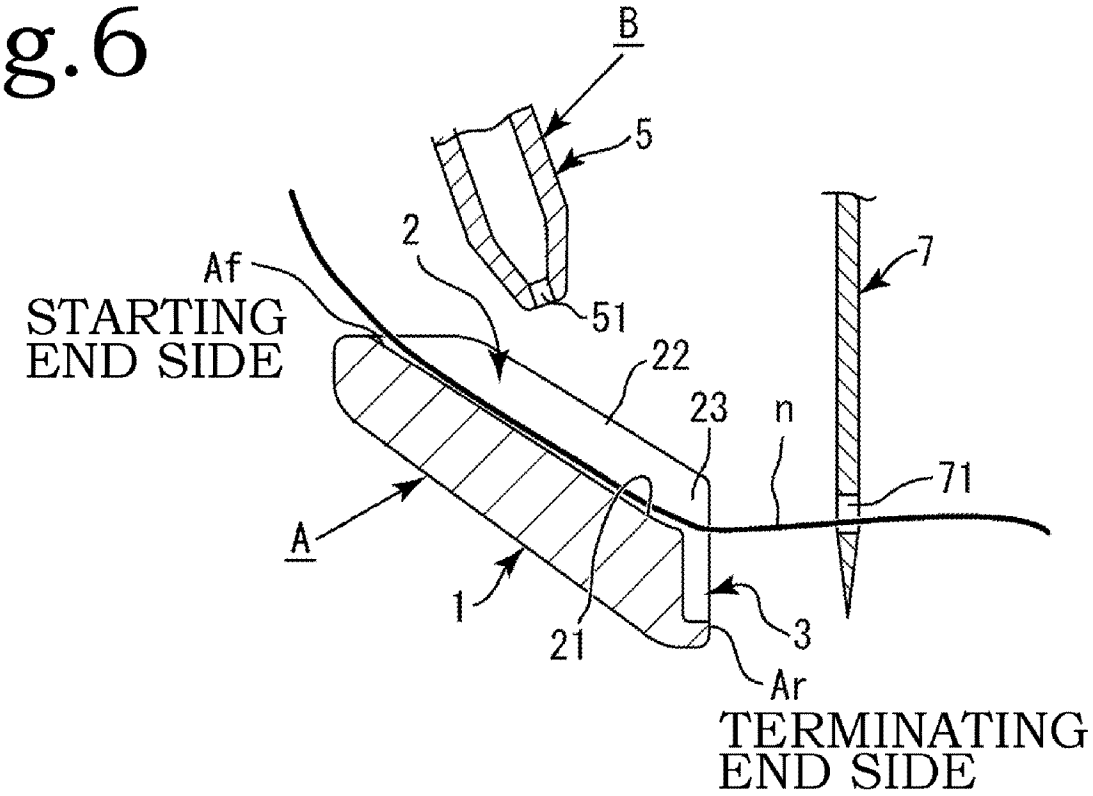
FIG. 6 is a longitudinal side view illustrating a state in which the threading operation is completed and the guiding member is separated from the needle.

When the threading operation of the sewing thread n into the needle hole 71 of the needle 7 is completed, the guiding member A and the air jetting nozzle 5 are moved away from the needle 7 and are withdrawn to a position so that a stitching operation is not affected. In the process of the withdrawing operation, the needle 7 and the sewing thread n are removed through the open portion of the upper surface of the guiding member A, whereby the threading operation is completed (see FIG. 6).

According to the second embodiment, the linear narrow groove portion is formed in the guiding path portion of the guiding member and the needle receiving portion is formed continuously to the narrow groove portion, whereby a thread path that connects the guiding path portion, the narrow groove portion, and the needle receiving portion is formed. As a result, the sewing thread can be reliably passed into the needle hole of the needle.

According to the third embodiment, the width of the opening of the guiding path portion of the guiding member facing the needle hole of the needle disposed in the needle receiving portion is equal to or smaller than the width of the needle hole. Thus, the sewing thread can easily pass through the needle hole of the needle. According to the fourth embodiment, the width of the narrow groove portion of the guiding path portion of the guiding member facing the needle hole of the needle disposed in the needle receiving portion is equal to or smaller than the width of the needle. Thus, the sewing thread can easily pass through the needle hole of the needle. According to the fifth embodiment, the position of the bottom of the opening of the guiding path portion of the guiding member is identical to the position of the lower end of the needle hole of the needle disposed in the needle receiving portion. Thus, the sewing thread can easily pass through the needle hole of the needle.

The invention claimed is:

1. A threading device of a sewing machine, comprising:

a needle bar which is supported on a sewing machine body so as to be slidable in an up-down direction and to a distal end of which a needle having a needle hole is attached;

a threading shaft member which is movably supported on the sewing machine body in parallel to the needle bar;

a guiding member provided at a lower end of the threading shaft member so as to guide a thread to the needle hole; and an air supplying member that supplies air to the guiding member, wherein the guiding member includes:

a guiding path portion of which a path width gradually narrows toward the needle hole such that the air supplied from the air supplying member pushes air guided toward the needle hole and of which an upper surface is open; and a needle receiving portion which is formed continuously, within the guiding member, to the guiding path portion so as to determine a position of the needle hole, and the needle and the thread passed through the needle hole are, after threading, removed through the open upper surface of the guiding member.

2. The threading device of a sewing machine according to claim 1, wherein a linear narrow groove portion is formed in the guiding path portion of the guiding member, and the needle receiving portion is formed continuously to the narrow groove portion.

3. The threading device of a sewing machine according to claim 1, wherein an opening of the guiding path portion of the guiding member facing the needle hole of the needle disposed in the needle receiving portion has a width equal to or smaller than a width of the needle hole.

4. The threading device of a sewing machine according to claim 2, wherein the narrow groove portion of the guiding path portion of the guiding member facing the needle hole of the needle disposed in the needle receiving portion has a width equal to or smaller than the width of the needle hole.

5. The threading device of a sewing machine according to claim 1, wherein a position of a bottom of an opening of the guiding path portion of the guiding member is identical to a position of the lower end of the needle hole of the needle disposed in the needle receiving portion.

6. The threading device of a sewing machine according to claim 2, wherein a position of a bottom of an opening of the guiding path portion of the guiding member is identical to a position of the lower end of the needle hole of the needle disposed in the needle receiving portion.

7. The threading device of a sewing machine according to claim 1, wherein the threading shaft member movably supported on the sewing machine body in parallel to the needle bar is selectively rotatable to a position such that the needle receiving portion of the guiding member at the lower end of the guiding member will receive the needle attached to the needle bar when the needle bar is in a down position.

8. The threading device of a sewing machine according to claim 7, wherein, when the needle attached to the needle bar is received by the needle receiving portion of the guiding member, the needle hole of the needle is aligned with an opening in a most narrow portion of the guiding path portion of the guiding member, such that a thread pushed along the guiding path will enter the needle hole of the needle.

9. The threading device of a sewing machine according to claim 8, wherein, when the air supplying member supplies air to the guiding member as a jet of air that is expelled from the air supplying member and pushes the thread along the guiding path toward the needle hole of the needle in the needle receiving portion of the guiding member.

10. The threading device of a sewing machine according to claim 7, wherein the needle and the thread that was passed through the needle hole are removed through the open upper surface of the guiding member by raising the needle bar to lift the needle upward out of the needle receiving portion of the guiding member and the thread that was threaded into the needle hole upward out of the open upper surface of the guiding member and then the threading shaft member is selectively rotated to a position that will not interfere with an up-down motion of the needle bar.

11. The threading device of a sewing machine according to claim 1, where the air supplied to the guiding member is supplied by an air pump.

12. The threading device of a sewing machine according to claim 11, wherein the air pump is operated electrically.

13. The threading device of a sewing machine according to claim 11, wherein the air pump is operated manually by a user of the sewing machine.

14. A sewing apparatus that supports the threading device according to claim 1, the sewing apparatus further comprising: a support mechanism for the needle bar; and a support for the threading shaft member which is movably supported on the sewing machine body in parallel to the needle bar.

15. A sewing machine that has mounted thereon the threading device according to claim 1.

16. A method of threading a needle mounted on a sewing machine, the method comprising:

lowering a needle bar supported on a sewing machine body of the sewing machine so as to be slidable in an up-down direction, a needle having a needle hole being attached to a distal end of the needle bar, the needle bar being lowered so as to position a lower tip of the needle into a needle receiving portion of a guiding member mounted on the sewing machine; and positioning a thread into an open upper surface of the guiding member, wherein the guiding member includes:

a guiding path portion of which a path width gradually narrows toward the needle hole of the attached needle such that air supplied from an air supplying member is guided toward the needle hole of the attached needle mounted on the needle bar, wherein an upper surface of the guiding path is open; and the needle receiving portion which is formed continuously, within the guiding member, to the guiding path portion so as to determine a position of the needle hole, wherein a jet of air is expelled from a tip of the air supplying member to push the positioned thread along the guiding path portion toward the needle and through the needle hole of the attached needle.

17. The method of threading a needle mounted on a sewing machine according to claim 16, wherein the guiding path portion of the guiding member includes a linear narrow groove portion formed in the guiding path portion of the guiding member, and the needle receiving portion is formed continuously to the narrow groove portion, the method further comprising raising the needle bar so as to lift the needle as threaded upward and out of the needle receiving portion of the guiding member and to lift the thread that was threaded into the needle hole upward out of the open upper surface of the guiding member.

18. The method of threading a needle mounted on a sewing machine according to claim 17, wherein the guiding member is mounted at a lower end of a threading shaft member which is movably supported on the sewing machine body in parallel to the needle bar, the method further comprising rotating the threading shaft member to a position that will not interfere with an up-down motion of the needle bar.

19. The method of threading a needle mounted on a sewing machine according to claim 16, wherein the jet of air is provided from an air pump that is operated electrically.

20. The method of threading a needle mounted on a sewing machine according to claim 16, wherein the jet of air is provided from an air pump that is manually operated by a user of the sewing machine.

* * * * *